United States Patent [19]

Kodama et al.

[11] Patent Number: 4,753,406

[45] Date of Patent: Jun. 28, 1988

[54] HANGER FOR KITCHEN APPLIANCES

[75] Inventors: Tatsuaki Kodama, Kouriyama; Tsuyoshi Takami, Nara, both of Japan

[73] Assignee: Matsushita Electric Industrial Co., Ltd., Japan

[21] Appl. No.: 842,364

[22] Filed: Mar. 19, 1986

[30] Foreign Application Priority Data

Mar. 20, 1985 [JP] Japan ..... 60-56813
May 14, 1985 [JP] Japan ..... 60-101854

[51] Int. Cl.[4] ..... A47F 5/08

[52] U.S. Cl. ..... 248/327; 248/542; 248/544; 312/245

[58] Field of Search ..... 248/317, 323, 327, 339, 248/544, 674, 675, 205.1, 542, 342–344, DIG. 6; 312/245, 247

[56] References Cited

U.S. PATENT DOCUMENTS

| | | | |
|---|---|---|---|
| 415,065 | 11/1889 | Rung | 248/413 |
| 974,681 | 11/1910 | Manquais | 248/201 |
| 1,453,017 | 4/1923 | Lindelof | 248/DIG. 6 X |
| 1,557,515 | 10/1925 | Wooley | 248/343 |
| 1,656,640 | 1/1928 | Kurowski | 248/680 |
| 1,693,396 | 11/1928 | Littleton | 248/DIG. 6 X |
| 2,291,492 | 7/1942 | Naysmith | 248/317 |
| 2,510,680 | 6/1950 | Byrnes | 248/542 X |
| 3,232,571 | 2/1966 | Josephson | 248/201 |
| 3,443,851 | 5/1969 | Earl | 312/245 |
| 3,698,780 | 10/1972 | Collins et al. . | |
| 4,094,486 | 6/1978 | Sunderlin . | |
| 4,313,043 | 1/1982 | White et al. . | |
| 4,580,853 | 4/1986 | Hitzeroth | 248/317 |

FOREIGN PATENT DOCUMENTS

| | | | |
|---|---|---|---|
| 1298250 | 5/1962 | France | 248/317 |

*Primary Examiner*—Alvin C. Chin-Shue
*Attorney, Agent, or Firm*—Lowe, Price, LeBlanc, Becker & Shur

[57] ABSTRACT

A hanger for hanging a kitchen appliance from a cabinet includes a metal plate adapted to be placed on a bottom panel of the cabinet and having a plurality of screw holes, a hook adapted to extend downwardly from the metal plate through the bottom panel, a bracket having a hook retaining hole for retaining the hook and a plurality of screw holes, an adjustment bolt and an adjustment nut threaded over the adjustment bolt and engaging the bracket, and a reinforcing attachment plate having a boss for engaging the adjustment bolt. The kitchen appliance can be attached to the cabinet by the hanger either using the bracket or without using the bracket. The boss serves to adjust a hanger height to meet the thickness of the bottom panel when the kitchen appliance is fixed directly to the cabinet without using the bracket and the adjustment bolt and nut.

5 Claims, 5 Drawing Sheets

HANGER FOR KITCHEN APPLIANCES

BACKGROUND OF THE INVENTION

The present invention relates to a hanger for hanging a kitchen appliance such as an electronic oven on a cabinet or the like at various installation sites and in small spaces.

There are known many types of kitchen cabinets on which kitchen appliances can be hung. The shapes of the bottom panels of available kitchen cabinets, where kitchen appliances are to be mounted, are of different types. One type is a flush bottom type as shown in FIG. 7 of the accompanying drawings, and another is a front rail bottom type as shown in FIG. 1 of the accompanying drawing. The flush-bottom-type cabinet has a flush bottom with no front rail or panel projecting downwardly beyond the cabinet bottom panel. The front rail bottom type cabinet has a front rail or panel projecting downwardly beyond the cabinet bottom panel. Therefore, hangers for kitchen appliances should accommodate such different cabinet designs as to shape and thickness of the bottom panel, height of the front rail etc.

FIG. 1 of the accompanying drawings shows a conventional hanger for a kitchen appliance 2 such as an electronic oven 2. A metal plate 24 is placed on the bottom panel 3 of a cabinet 1, and screws 25 are inserted downwardly through the metal plate 24 and the bottom panel 3, and threaded through respective resilient spacers 26 into an elongate bracket 27, each of the spacers 26 comprising one or more stacked pads. The electronic oven 2 has a reinforced upper panel (not shown in FIG. 1) from which mushroom-shaped hooks 28 extend upwardly. For hanging the electronic oven 2 from the cabinet bottom panel 3, the hooks 28 are inserted and shifted laterally in holes 29 defined in the bracket 27 to suspend the electronic oven 2 from the bracket 27, and then the screws 25 are tightened to anchor the bracket 27 securely to the cabinet 1.

When the electronic oven 2 is to be attached directly to the bottom panel 3 of the cabinet 1, the bracket 27, the spacer pads 26, and the mushroom-shaped hooks 28 are dispensed with, as shown in FIG. 2. The electronic oven 2 includes an inner reinforcing attachment panel 30 having threaded holes 31 into which screws 32 are threaded through the bottom panel 3 and the metal plate 24 to couple the electronic oven 2 directly to the cabinet 1.

The hanger shown in FIG. 1 is adjustable as follows: Depending on the height of front panel 17 of the cabinet 1, the length of the screws 25 and the number of the spacer pads are varied to adjust the vertical distance between the cabinet bottom panel 3 and the bracket 27. Therefore, many screws 25 of different lengths and many spacer pads have to be kept ready for use. The electronic oven 2 as it is installed is relatively unstable since the bracket 27 is secured to the bottom panel 3 by the screws 25 through the resilient pads 26. Another problem is that the hooks 28 are likely to disengage from the bracket 27 because the hooks 28 are retained on the bracket 27 only through frictional engagement therewith. Furthermore, the upper panel, denoted 18 in FIG. 2, of the electronic oven 2 has to be reinforced inasmuch as the hooks 28 are subject to concentrated stress when the electronic oven 2 is suspended from the bracket 27. When the electronic oven 2 is used directly on a countertop, with the illustrated hanger as an optional component, the reinforcement of the upper panel 18 is a wasteful cost increase.

For attaching the electronic oven 2 directly to the bottom panel 3 of the cabinet 1 as shown in FIG. 2, it is necessary to register the threaded holes 31 of the inner reinforcing attachment panel 30 with the holes of the metal plate 24 and the bottom panel 3 in the attachment procedure. However, such a registering process is not easy to carry out since the upper panel 18 and the bottom panel 3 do not have any projections or recesses serving as registering aids. The electronic oven 2 utilizes high-voltage electric energy for its operation, and the threaded insertion of the screws 32 into the electronic oven 2 is not preferred since screws 32 may deeply enter the electronic oven 2 dependent on the thickness of the bottom panel 3 and the length of the screws 32.

SUMMARY OF THE INVENTION

In view of the aforesaid drawbacks of the conventional hangers for kitchen appliances, it is an object of the present invention to provide a hanger for hanging a kitchen appliance, which hanger has an adjustable bracket, and allows the kitchen appliance to be installed in place stably, securely, and efficiently.

To achieve the above object, a hanger for hanging a kitchen appliance from a cabinet includes a metal plate adapted to be placed on a bottom panel of the cabinet and having a plurality of screw holes, a hook adapted to extend downwardly from the metal plate through the bottom panel, a bracket having a hook retaining hole for retaining the hook and a plurality of screw holes, an adjustment bolt and an adjustment nut threaded over the adjustment bolt and engaging the bracket, and a reinforcing attachment plate having a boss for engaging the adjustment bolt.

When the kitchen appliance is fixed to a cabinet having a flush bottom panel, the bracket, the adjustment bolt and nut are unnecessary. Therefore, the kitchen appliance is fixed directly to the cabinet without using the bracket, and the boss of the reinforcing attachment plate serves as means for adjusting a hanger height to meet the thickness of the bottom panel. The present invention can accommodate both cabinet types, as defined above, using the same hanger.

When the hanger is employed to install the kitchen appliance on the cabinet with a front rail or panel, the bracket can easily be adjusted in height to meet the height of a front panel of the cabinet simply by turning the adjustment nut, without changing the screw or spacer pads which would otherwise be required. The kitchen appliance can securely be fixed to the cabinet by first retaining the bracket on the hook and then fastening the bracket to the cabinet by screws. Since the reinforcing attachment plate is fastened, together with an upper panel of the kitchen appliance, to a casing thereof, and the bracket is coupled to the reinforcing attachment plate, the kitchen appliance is not required to be provided with a special reinforcement.

When the hanger is employed to install the kitchen appliance on the flush bottom type cabinet, the bracket should be eliminated, and then the boss of the reinforcing attachment plate for engaging the adjustment bolt can easily be aligned with a companion screw hole in the bottom panel through a visual check and a feel or tactile check. Since the reinforcing attachment plate is not disposed in the kitchen appliance itself, screws used for attaching the bracket to the bottom panel are prevented from deeply entering into the kitchen appliance. The height of the hanger can easily be adjusted by the boss and the companion screw to meet the thickness of the bottom panel of the cabinet.

BRIEF DESCRIPTION OF THE DRAWINGS

The present invention will be described in detail by way of illustrative example with reference to the accompanying drawings, in which.

DETAILED DESCRIPTION

Figure 1:
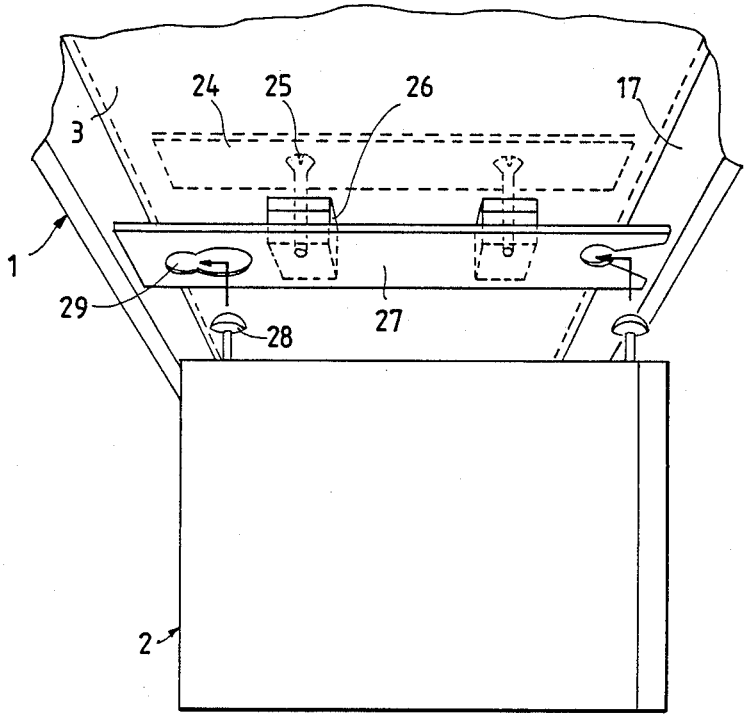
FIG. 1 PRIOR ART
FIG. 1 is an exploded perspective view of a conventional hanger employing a bracket for installing a kitchen appliance.
Figure 2:
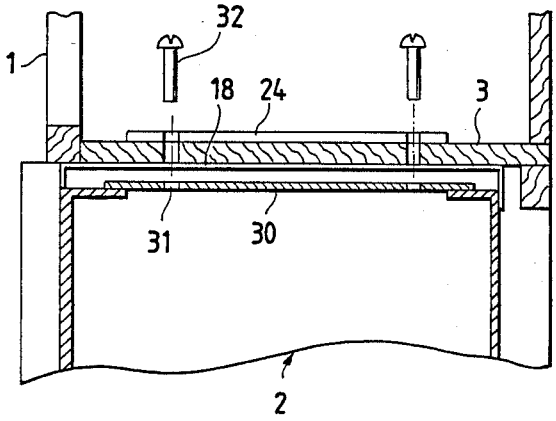
FIG. 2 PRIOR ART
FIG. 2 is a cross-sectional view of another conventional hanger using no bracket for installing a kitchen appliance.
Figure 3:
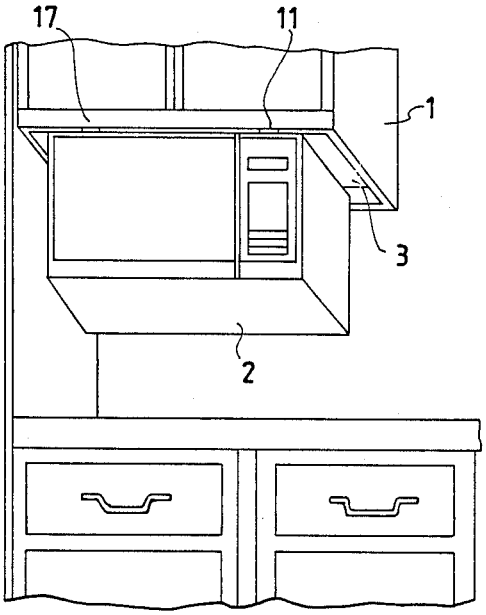
FIG. 3 is a perspective view of a kitchen appliance suspended by a hanger according to the present invention.
Figure 4:
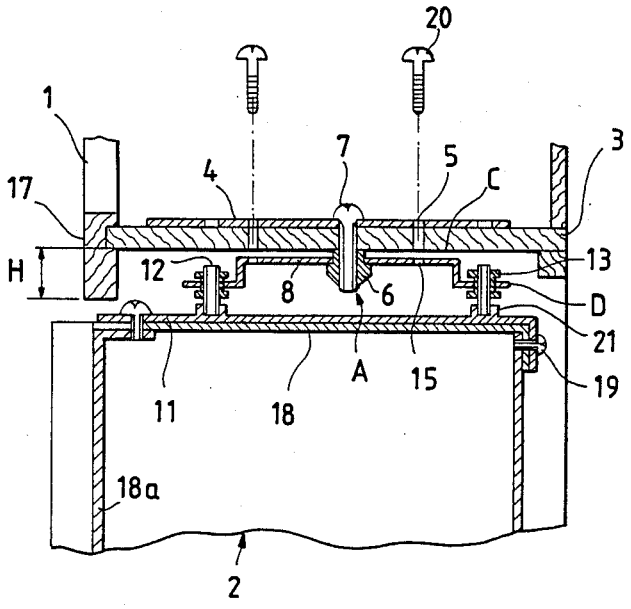
FIG. 4 is a cross-sectional view of the hanger of the invention with brackets used.

FIGS. 3 and 4 illustrate a kitchen appliance 2 such as an electronic oven which is hung from a cabinet 1 attached to a wall of a kitchen. The cabinet 1 has a horizontal bottom panel 3 on which there is placed a supporting metal plate 4 having a plurality of screw holes 5. A nut 6 of an inverted mushroom shape is threaded over a screw 7 depending downwardly from the metal plate 4 through the bottom panel 3, the nut 6 comprising a larger-diameter head for retaining a bracket 8 and a smaller-diameter shank for spacing the larger-diameter head from the bottom panel 3. The nut 6 and the screw 7 constitute a hook A.

Figure 5:
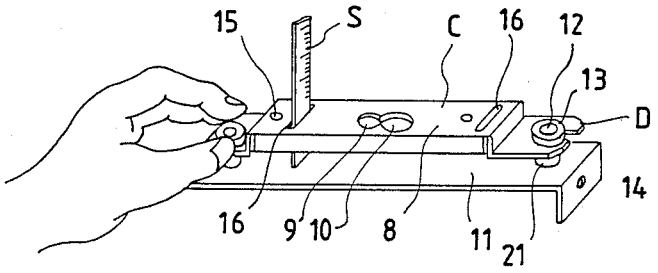
FIG. 5 is a perspective view of the hanger shown in FIG. 4.
Figure 6:
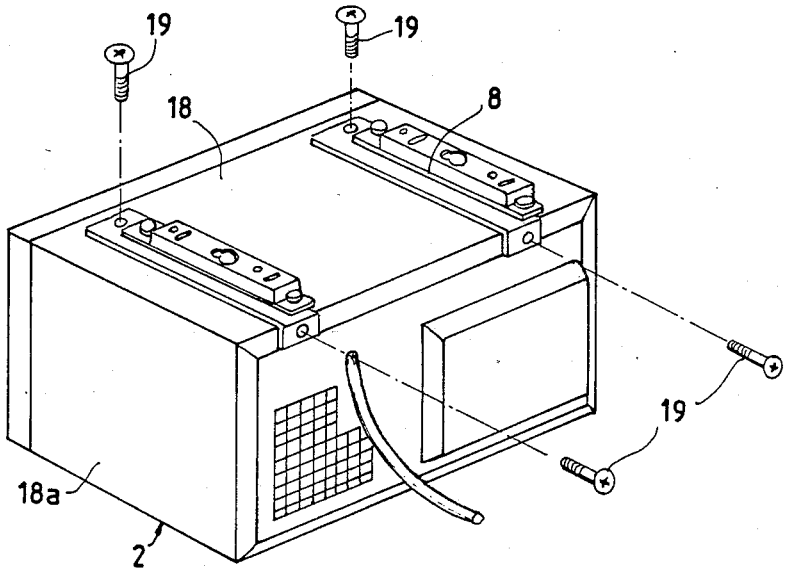
FIG. 6 is a perspective view showing the manner in which the hanger is fixed to the kitchen appliance.

As shown in FIGS. 4 and 5, the bracket 8 has a central portion C for engaging the bottom panel 3 and a pair of end portions D stepped or staggered transversely from the central portion C. The central portion C has a circular hook retaining hole 9 defined therein and contiguous to a circular guide hole 10 having a diameter sufficiently larger than that of the nut 6 of the hook A. The end portions D of the bracket 8 have respective U-shaped recesses 14. A reinforcing attachment plate 11 has bracket attachment bosses 21 on its respective ends, in which adjustment bolts 12 are threadedly mounted. The bracket 8 and the reinforcing attachment plate 11 are coupled by inserting the edges of the U-shaped recesses 14 in grooves defined in the peripheries of the adjustment nuts 13 threaded over the respective adjustment bolts 12. Therefore, the bracket 8 and the reinforcing attachment plate 11 are adjustable or variable in height or spacing by turning the adjustment nuts 13. The bracket 8 has screw holes 15 and scale slots 16 defined in the central portion C for inserting a scale S therein to allow the height of the bracket 8 to be easily adjusted to the height H of a front panel 17 (FIG. 4) of the cabinet 1. As illustrated in FIGS. 4 and 6, each reinforcing attachment plate 11 and an upper panel 18 of the electronic oven 2 are fastened together to an oven casing 18*a* by screws 19. The metal plate 4 and the bracket 8 are fastened to each other with the bottom panel 3 interposed therebetween by screws 20 extending through the screw holes 5 and threaded in the screw holes 15.

Figure 7:
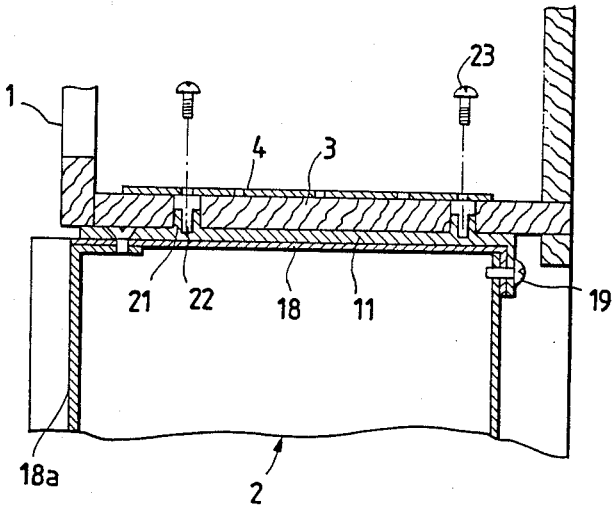
FIG. 7 is a cross-sectional view of the hanger with the brackets not used.

FIG. 7 shows the manner in which the electronic oven 2 is attached to the cabinet 1 having no front panel, without using the bracket 8. The bracket attachment bosses 21 have screw holes 22 each having an effective threaded length covering the total of the range of thicknesses available of the bottom panel 3 of the cabinet 1 and the effective minimum threaded length for engagement with the screw 23. The bracket attachment bosses 21 therefore serve as means for adjusting the hanger to meet the thickness of the bottom panel 3 used.

A procedure for attaching the electronic oven 2 to the cabinet 1 having the front panel 17 with the bracket 8 will first be described below. As shown in FIG. 5, a scale S is inserted through one of the scale slots 16, and the adjustment nuts 13 are manually turned to adjust the height of the bracket 8 while observing the scale. After the bracket 8 is adjusted to a desired height, two reinforcing attachment plates 11, together with the upper panel 18, are secured by the screws 19 to the oven casing 18*a* as shown in FIG. 6. Thereafter, as illustrated in FIG. 4, the electronic oven 2 is manually raised so that the hooks A projecting downwardly from the metal plates 4 through holes in the bottom panel 3 will enter the guide holes 10, and then the electronic oven 2 is pushed back to bring the hooks A into the hook retaining holes 9. Subsequently, the screws 20 are inserted through the screw holes 5 of the metal plate 4 from within the cabinet 1 and threaded into the screw holes 15. As the screws 20 are tightened, the bracket 8 is lifted into abutting engagement with the bottom panel 3, whereupon the electronic oven 2 is fixed to the cabinet 1. The screw holes 5, 15 are positioned such that they are registered when the hook A is disposed in the hook retaining hole 9. Therefore, the installation procedure can easily and reliably be carried out by one worker.

Figure 8A:
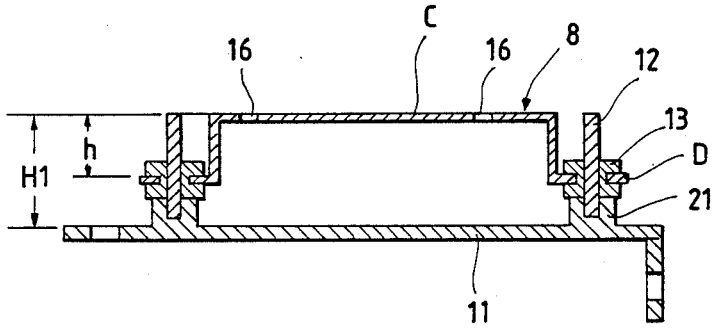
FIGS. 8A and 8B are cross-sectional views illustrating the manner which the height of the hanger is adjusted.
Figure 8B:
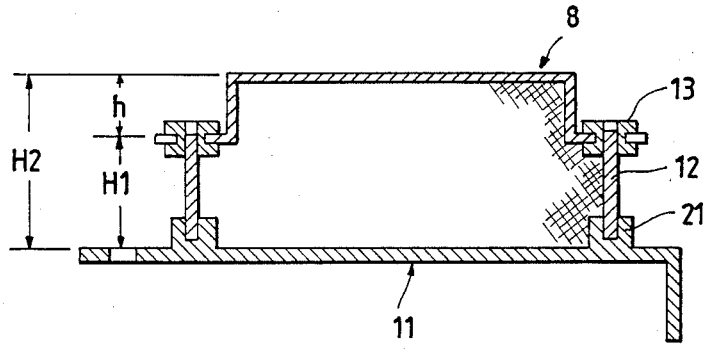

The height of the bracket 8 with respect to the reinforcing attachment plate 11 can be adjusted as shown in FIGS. 8A and 8B. In FIG. 8A, the height of the bracket 8 is selected to be a minimum level Hl, with the adjustment nuts 13 resting on the bosses 21 and the upper ends of the adjustment bolts 12 being at the same level as that of the central portion C of the bracket 8. In FIG. 8B, the adjustment nuts 13 are turned back to hold the bracket 8 at a maximum level H2, which is equal to the sum of the minimum level Hl and the height h of the step of the bracket 8. As a consequence, the height of the bracket 8 with respect to the reinforcing attachment plate 11 is continuously adjustable between the height levels Hl and H2.

Where the cabinet 1 has no front panel and hence the bottom panel 3 thereof is flat at its front end, the brackets 8, the adjustment bolts 12, and the adjustment nuts 13 are not used, and the electronic oven 2 is attached directly to the bottom panel 3, as shown in FIG. 7. In order to mount the electronic oven 2 on the cabinet 1, the reinforcing attachment plate 11, together with the upper panel 18, is first fixed to the oven casing 18*a* by the screws 19. Then, the electronic oven 2 is raised and positioned horizontally until the bosses 21 are aligned with the holes of the bottom panel 3 through a visual check and a feel or tactile check. Thereafter, the screws 23 are inserted through the metal plate 4 and the bottom panel 3, and threaded into the bosses 21. Different thicknesses of bottom panels 3 can be accommodated by adjusting the depth by which the screws 23 enter the screw holes 22 of the bosses 21 in threaded engagement therewith.

The hanger for kitchen appliances according to the present invention has the following advantages:

(1) Since the bracket and the reinforcing attachment plate are coupled by the height adjustment bolt and nut, the hanger can be adjusted to meet the height of the front panel of the cabinet without changing the bolts and spacer pads which would otherwise be required. Therefore, the height adjustability of the bracket is improved, and the number of parts required is reduced.

(2) After the hook is inserted and retained in the hook retaining hole of the bracket, the bracket is coupled to the bottom panel by the screws inserted through the metal plate and the bottom panel. Therefore, the bracket is attached securely and stably.

(3) The screws which originally fasten the upper panel of the electronic oven may be detached, and the reinforcing attachment panel may be fastened, together with the upper panel, to the oven casing by the screws. Therefore, the hanger may be used as an optional component, and the electronic oven may be suspended from the cabinet by the hanger without requiring any special arrangement on the electronic oven itself. Therefore, an undesirable increase in the cost of the electronic oven itself can be avoided. Since the reinforcing attachment plate is not disposed within the electronic oven, the screws inserted through the reinforcing attachment plate are prevented from entering deeply into the electronic oven.

(4) The hanger can be adjusted in height to meet the height of the front panel of the cabinet and the thickness of the bottom panel thereof either when the front panel projects downwardly and the bracket is used or when the bottom panel is flat with no front panel projecting downwardly and the bracket is not used. The bosses 21 employed to support the height adjusting mechanism used when the bracket is employed serve as means for adjusting the height of the hanger to meet the thickness of the bottom panel when the bracket is not employed. Therefore, the bosses 21 are utilized in each of the adjustment modes.

(5) The electronic oven can be installed even by one worker since it is first loosely attached by the hooks A to bottom panel and then fixed thereto by the screws.

(6) When the electronic oven is mounted on the bottom panel without using the bracket, the screw holes can easily be registered through a visual check and a feel because of the bosses on the reinforcing attachment plate. Thus, the efficiency of the installing process is increased.

(7) When the kitchen appliance is installed, there is substantially no gap left between the cabinet and the kitchen appliance. Therefore, the combined appearance of the cabinet and the kitchen appliance is neat and simple in each of the methods of installation.

According to the present invention, therefore, a kitchen appliance can be installed by the hanger of the invention inexpensively and efficiently at various installation sites and in small spaces. The hanger of the present invention can be used to hang various kitchen appliances other than the illustrated electronic oven, such as an electric oven, a gas cooking device, or their combination, for example.

Although a certain preferred embodiment of the present invention has been shown and described in detail, it should be understood that various changes and modifications may be made therein without departing from the scope of the appended claims.

What is claimed is:

1. A hanger for hanging a kitchen appliance from a bottom panel of a cabinet, comprising:

support means for engaging the cabinet bottom panel;

temporary supporting hook means depending from said support means;

fixing means for engaging said temporary supporting hook means;

variable height adjustment means for adjusting the height of said fixing means by an infinitely variable amount with respect to the height of a front panel of the cabinet;

reinforcing attachment means for being coupled to the kitchen appliance and engaging said fixing means through said height adjustment means, said reinforcing attachment means having a boss serving selectively as a coupler for one of (1) engaging said variable height adjustment means for mounting an appliance to the bottom panel of the cabinet formed with a front panel and (2) as variable thickness adjustment means received in the bottom panel of the cabinet for accommodating the thickness of the bottom panel of the cabinet formed without a front panel, wherein said support means comprises a metal plate adapted to be placed on the bottom panel of said cabinet and having a plurality of screw holes, said temporary supporting hook means comprises a hook adapted to extend downwardly from said metal plate through said bottom panel, said fixing means comprises a bracket having a hook retaining hole for retaining said hook and a plurality of screw holes, said variable height adjustment means comprises an adjustment bolt and an adjustment nut threaded over said adjustment bolt and engaging said bracket, and said reinforcing attachment means comprises a reinforcing attachment plate coupled to said adjustment bolt and adapted to be secured to an upper panel of said kitchen appliance, wherein said boss includes an internal threaded socket portion adapted to receive the adjustment bolt.

2. A hanger according to claim 1, wherein said bracket comprises a central portion adapted to engage said bottom panel of the cabinet and a pair of end portions stepped transversely from said central portion for a distance, said adjustment nut being movable along said adjustment bolt within said distance for continuous adjustment of the height of said bracket with respect to said reinforcing attachment plate, said adjustment nut having a groove defined around its periphery, said bracket having a recess defined in each of opposite ends thereof by edges which are fitted in said groove of said adjustment nut.

3. A hanger according to claim 1, wherein said hook comprises a screw and a nut of an inverted mushroom shape threaded over said screw and having a larger-diameter head retaining said bracket and a smaller-diameter shank for spacing said larger-diameter head from said bottom panel, so that said hook is adjustable with respect to the thickness of said bottom panel and allows temporary hooking engagement with said bottom panel.

4. A hanger according to claim 1, wherein said bracket has a portion adapted to engage the bottom panel of said cabinet and having a scale slot for inserting a scale to facilitate adjustment of the height of said bracket.

5. The hanger of claim 1, wherein the bottom of the threaded socket portion is located above an upper panel of the kitchen appliance.

* * * * *